US006226943B1

(12) United States Patent
Grinshpun et al.

(10) Patent No.: US 6,226,943 B1
(45) Date of Patent: May 8, 2001

(54) WALL SYSTEM AND INSULATION PANEL THEREFOR

(75) Inventors: Vyacheslav S. Grinshpun; Michael E. Schaller, both of Midland, MI (US)

(73) Assignee: The Dow Chemical Company, Midland, MI (US)

( * ) Notice: Subject to any disclaimer, the term of this patent is extended or adjusted under 35 U.S.C. 154(b) by 0 days.

(21) Appl. No.: 09/236,986

(22) Filed: Jan. 26, 1999

(51) Int. Cl.[7] ..... E04B 1/74

(52) U.S. Cl. ..... 52/309.4; 52/309.6; 52/309.8; 52/406.2; 52/406.3

(58) Field of Search ..... 52/309.8, 309.4, 52/309.6, 404.1, 405.1, 406.2, 406.3, 481.1

(56) References Cited

U.S. PATENT DOCUMENTS

| | | | | |
|---|---|---|---|---|
| 3,455,076 | * | 7/1969 | Clarvoe | 52/309.8 X |
| 3,958,385 | * | 5/1976 | Bondra, Jr. et al. | 52/404.1 |
| 4,109,436 | * | 8/1978 | Berloty | 52/309.2 |
| 4,228,624 | * | 10/1980 | Reneault | 52/404.1 X |
| 4,571,909 | | 2/1986 | Berghuis et al. . | |
| 4,674,253 | | 6/1987 | Young . | |
| 4,682,458 | * | 7/1987 | Sparrow | 52/404.1 X |
| 4,712,347 | | 12/1987 | Sperber . | |
| 4,723,385 | | 2/1988 | Kallstrom . | |
| 4,804,695 | | 2/1989 | Horton . | |
| 4,952,441 | | 8/1990 | Bose et al. . | |
| 5,016,412 | | 5/1991 | Grochal . | |
| 5,067,296 | | 11/1991 | Brown et al. . | |
| 5,092,092 | | 3/1992 | Kiekens et al. . | |
| 5,287,674 | | 2/1994 | Sperber . | |
| 5,356,446 | | 10/1994 | Smetana et al. . | |
| 5,360,653 | * | 11/1994 | Ackley | 52/309.4 X |
| 5,365,716 | | 11/1994 | Munson . | |
| 5,545,453 | * | 8/1996 | Grant | 52/406.2 X |
| 5,666,780 | | 9/1997 | Romes et al. . | |
| 5,822,940 | * | 10/1998 | Carlin et al. | 52/309.4 X |
| 6,083,594 | * | 7/2000 | Weinstein et al. | 52/404.1 X |

FOREIGN PATENT DOCUMENTS

| | | |
|---|---|---|
| 2272229 | 5/1994 | (GB) . |

OTHER PUBLICATIONS

"Insulwall", publication of Beaver Plastics, printed from web site on Feb. 16, 1998.

* cited by examiner

*Primary Examiner*—Carl D. Friedman
*Assistant Examiner*—Brian E. Glessner

(57) ABSTRACT

An insulating polymer foam sheet having two major sides and at least one groove in at least one of said sides. At least a portion of the foam sheet adjacent to the groove is compressible and resilient, and has a length and height the same as the adjacent groove. Each groove and compressible portion is of a width that permits the groove to receive and tightly fit around a support member in a frame building construction.

19 Claims, 5 Drawing Sheets

WALL SYSTEM AND INSULATION PANEL THEREFOR

BACKGROUND OF THE INVENTION

This invention relates to building construction and, more particularly, to assemblies of materials used in the walls of homes, offices, and other buildings where insulation against wind, water, or outside temperatures is necessary.

A common type of wall construction is wood frame construction as illustrated in FIGS. 1A and 1B. In this type of construction, wood studs are used to make an outer frame 1 having a wall height WH with inner support members 2. Glass wool or cellulose fiber insulation 3 is placed between the studs. FIG. 1B is a cross section of a frame construction that also uses exterior sheets of polystyrene foam sheet, plywood, or oriented strand board 4, which are attached to the portion of the frame that will form the exterior portion of the wall. If desired, the exterior wall may be covered with a wrap of a plastic film material (such as Tyvek™ film) 5.

The installation of glass wool, cellulose fibers, or other insulating materials such as "blown-in-place" foams between the studs in a separate step is often a time-consuming process. The fibers in fiber-based insulation are often irritating if inhaled, and formaldehyde-based resins used in such insulation may contain free formaldehyde. Blown-in-place foams prepared on site are often difficult to precisely control during the foaming and installation process, which may lead to an excess of wasted material, in addition to any chemical exposure risks that may be involved in their use. Any of the above-mentioned insulating materials may deteriorate and partially collapse within the wall over time, resulting in a decrease in insulation efficiency. In addition, such materials may absorb moisture and be susceptible to mildew growth.

SUMMARY OF THE INVENTION

In one aspect, this invention is an insulating polymer foam sheet having two major sides and at least one groove in at least one of said sides, wherein at least a portion of the foam sheet adjacent to the groove is compressible and resilient, said portion having a length and height the same as a groove adjacent thereto;

and wherein each groove and compressible portion is of a width which will permit the groove to receive and tightly fit around a support member in a frame building construction.

In another aspect, this invention is a building wall assembly, comprising:

(a) a plurality of support members; and (b) an insulating polymer foam sheet having at least one groove in at least one of its two major sides, wherein at least a portion of the foam sheet adjacent to the groove is compressible and resilient, said portion having a length and height the same as a groove adjacent thereto;

and wherein at least one of said support members is positioned in said groove, which fits tightly around said support member.

It has been discovered that the use of a foam or multilayer foam composite having the above-described profiles and resiliency characteristics provides a more efficient means to construct a wall having desirable insulation properties. These and other advantages of the invention will be apparent from the description that follows.

DETAILED DESCRIPTION OF THE PREFERRED EMBODIMENTS

Figure 1A:
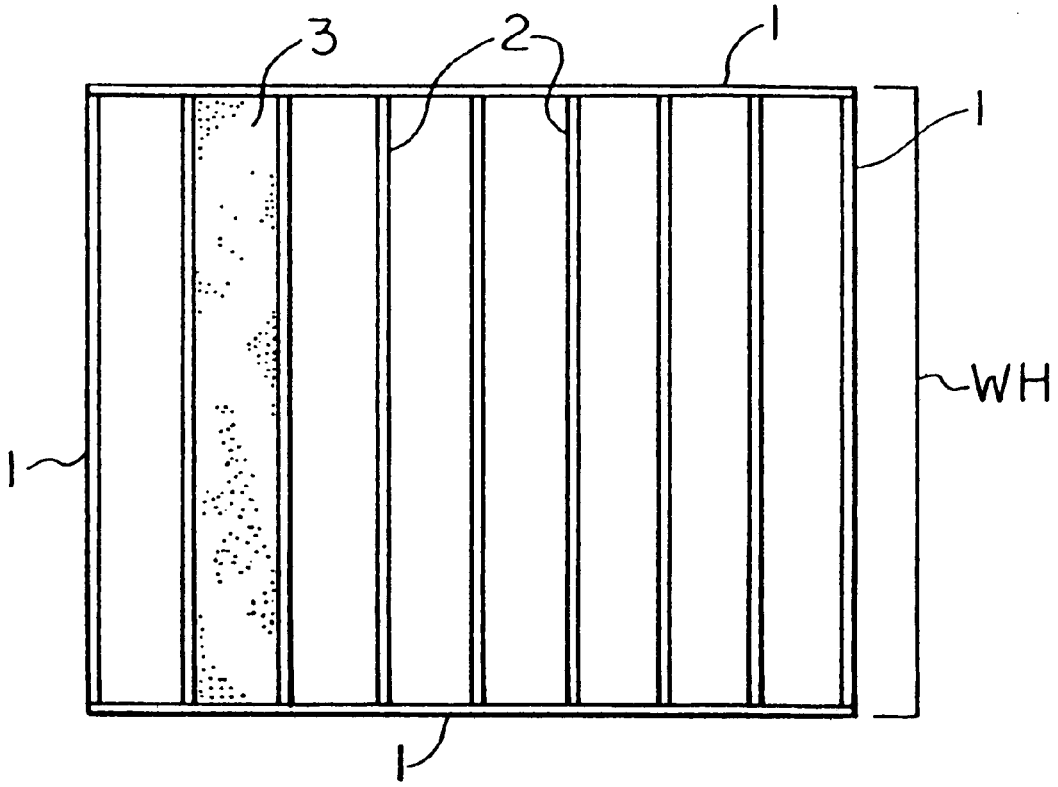
FIG. 1A PRIOR ART
FIGS. 1A and 1B illustrate wood frame construction components of the prior art.
Figure 1B:
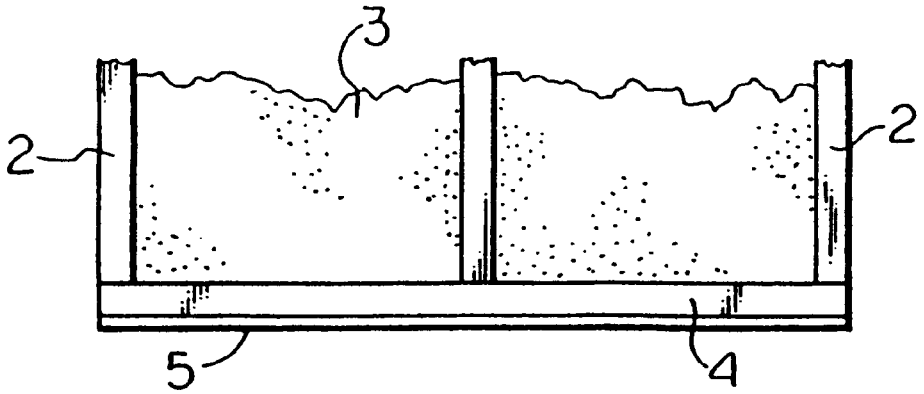
FIG. 1B PRIOR ART

The support members used to make the wall assembly of this invention may be of any material having compressive properties sufficient for use as a structural member that can support the weight of the building components attached to it, and may have any suitable shape and dimensions. Examples of suitable materials include lumber, molded polymer-based materials, aluminum, steel, and concrete. Preferably, the support member is a vertically-positioned stud, as is commonly used as an upright in frame building construction to which exterior sheathing or siding and/or interior drywall is attached.

National or local building codes often regulate the dimensions and material of construction of the support members. Accordingly, the preferred dimensions and materials for a sheet may vary somewhat depending on the type, design and location of the building. For example, for frame single unit housing in the United States, the support members typically have a cross sectional dimension of about 1 to 3 inches by about 3 to 8 inches, with the most common dimensions being nominal 2×4, 2×6, 2×8, 2×10 or 2×12 inches, with the actual dimensions all being approximately ½ inch less than the nominal dimensions. However, the grooves in the foam board may be sized to accommodate support members of any size. The length of the support member also depends on various factors and is not critical to the invention. Typical lengths vary from 1 foot to 16 feet or more, with 4–12 feet being most typical.

The spacing of the support members is also usually specified by various building codes. Typically, adjacent support members will be approximately regularly spaced (i.e. the spacing does not vary by more than about 10 percent of the nominal distance between support members), and at least about 12 inches apart. In the United States, adjacent vertical support members are most typically spaced 16 inches apart on center. Since it is often difficult to achieve exact equal spacing when the wall is constructed by hand, one of the advantages of the invention is that the use of a compressible and resilient foam between the support members permits the foam to adequately fill all of the available space even if the spacing between the support members is not exact.

Any suitable process may be used to prepare the building wall assembly. In one embodiment, the process may comprise attaching the support members to each other to make a suitable frame, and then attaching the frame to other building components to keep it in an upright position. Next, the foam sheet is positioned adjacent to the frame and pushed against the frame so that the support members go into the grooves. It may be necessary for one or more persons to stand on the grooved side of the foam and compress the foam near the grooves and guide the grooves around the support members. In another embodiment, the foam may be inserted into the frame before the frame is attached to the other building components.

Another advantage of the invention is that the foam sheet may, if desired, be used as a template for making the frame assembly. In this embodiment, the foam sheet is first laid down on a flat surface, with the grooved side facing upwards. Next, the vertical support members are positioned in the grooves, and the horizontal members of the frame are attached to the vertical members by any suitable means. This method may also more easily achieve the most insulating fit of the resilient foam around the support members in foam sheet embodiments wherein the width of the grooves closely approximates the exact width of the support members.

Figure 2A:
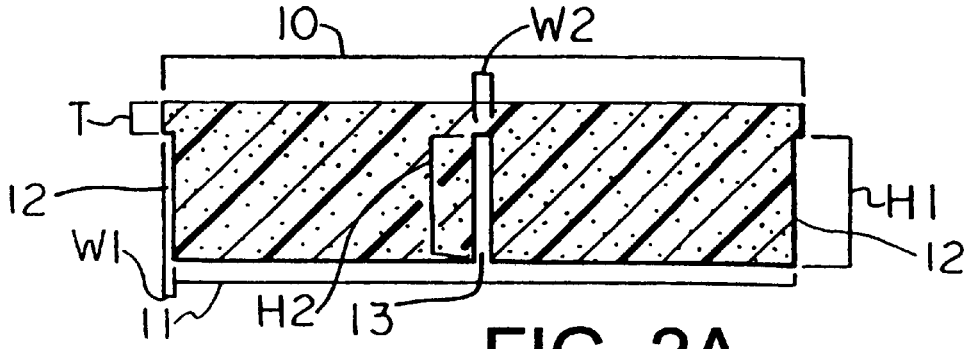
FIGS. 2A, 3A, 4A, 5, and 6 illustrate several embodiments of the foam sheet of the invention.
Figure 2B:
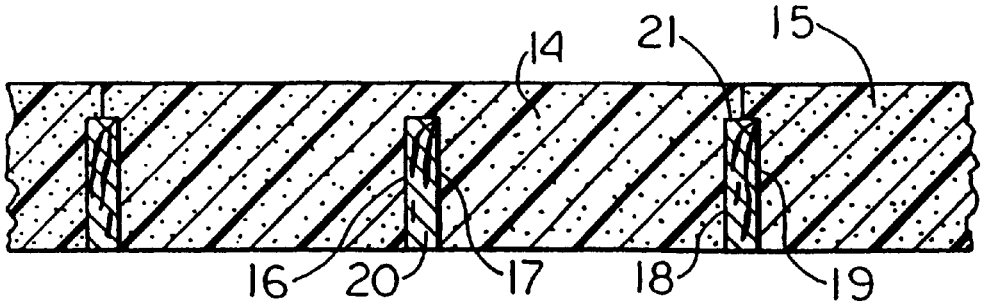
FIGS. 2B, 3B, 4B, and 4C illustrate several embodiments of the building wall assembly of the invention.

As illustrated in FIGS. 2A and 2B, the polymer foam sheet of the invention is generally in the shape of a board having six sides with at least one groove 13 in one of the major sides 10 and 11 to accommodate the shape of the support members. The term "sheet" as used herein means a substantially flat article (except for the presence of groove in the surface of the article) having a thickness substantially smaller than its width and length, and includes articles having thicknesses as are commonly referred to as "planks" or "boards". The groove is of a size that will permit it to receive and tightly fit around the support member, so that there are no empty spaces between the two major sides of the support member and foam through which air can travel unimpeded. Each groove may be in the form of a cutouts 12 along an edge of a major side of the foam sheet, or of a second type that is generally U-shaped 13 and presses against two opposite sides of a support member.

In FIG. 2B, foam sheets 14 and 15 are shown in contact with the major sides 16, 17, 18, and 19 of support members 20 and 21 as in a wall construction. Grooves of the first type may have a height H1 and a width W1. The width W1 of grooves 12 is approximately equal to and preferably slightly less than the ½ of the width of the support member 21. When two foam sheets are abutted in a wall construction, the grooves at the abutting edges of the foam sheets 14 and 15 together form a wider groove which fits tightly about the intervening support member 21. When the foam sheet is wider than the spacing between two consecutive support members, the sheet will contain one or more wider U-shaped grooves 13. These wider grooves have a width W2 which is approximately equal to or preferably slightly less than the corresponding width of the support member, so that when the foam sheet is attached to the wall construction, the wider groove 13 fits tightly around support member 20. In this embodiment, the heights H1 and H2 of the grooves 12 and 13 are approximately equal to the height of the support members 20 and 21.

It is preferred that the grooves 12 and 13 fit tightly enough around the support members so that any empty spaces in a wall assembly through which air can travel unimpeded will be minimized or eliminated.

At least the portion of the foam sheet adjacent to the groove is compressible and resilient. This permits the foam to yield somewhat to permit the support member to be inserted tightly into the groove without tearing the foam. When the foam sheet is brought into contact with the support member, the areas of the foam sheet adjacent to the groove may be compressed as needed to more easily admit the support member into the groove. The compressible and resilient portion of the foam will then expand after the support member is inserted so as to at least partially fill small irregularities in the side of the support member and ensure a tight fit of the support member in the groove.

The groove(s) preferably run the entire length of the foam sheet. The height of the grooves can vary up to the corresponding height of the support member. It is preferred that the height of the grooves be at least about 1 inch to about 11½ inches, but not greater than the corresponding height of the support member. It is more preferred that the height of the grooves be approximately equal to the height of the support member, as the maximum structural support and insulating value is obtained in that manner.

Although the entire foam sheet can be of a compressible and resilient material, as shown in FIG. 2A, it is only necessary that the portions of the sheet adjacent to the board be compressible and resilient. Other portions of the foam sheet can be more rigid.

Figure 3A:
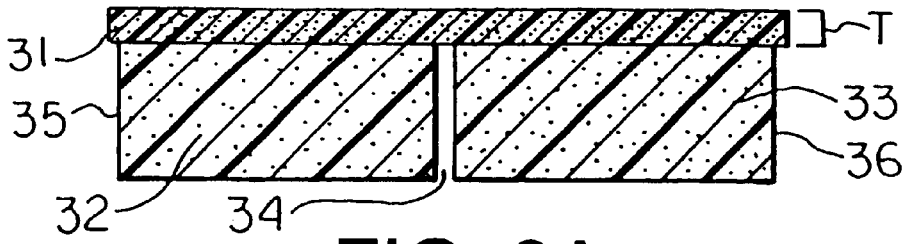
Figure 3B:
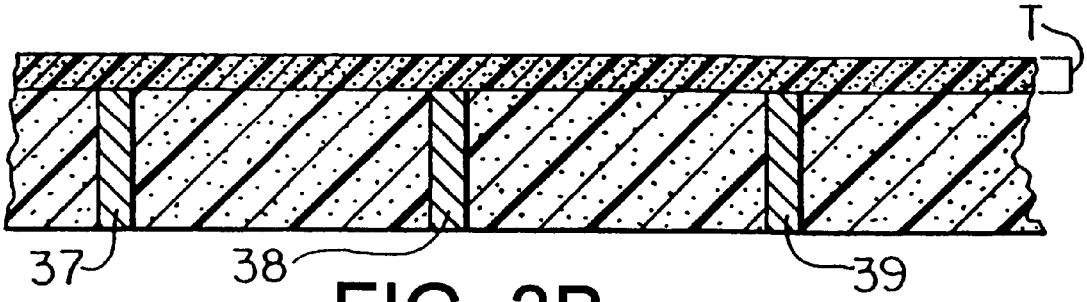

A second embodiment of the invention is shown in FIGS. 3A and 3B. In FIG. 3A, the foam sheet comprises a section 31 made from a rigid foam and sections 32 and 33 that are made from a more compressible and resilient foam. The sections 32 and 33 are separated by groove 34 into which the support member will be fitted. As depicted, the foam sheet has two sections separated by a single groove. However, it is within the scope of this invention to use a greater number of sections separated by a correspondingly greater number of grooves. As in FIGS. 2A and 2B, the foam sheet in FIG. 3A has cutout grooves 35 and 36 at the edges of the sheet, parallel to U-shaped groove 34. In FIG. 3B, a foam sheet of the type shown in FIG. 3A but having three U-shaped grooves is shown in place in a wall construction, in which support members 37, 38, and 39 are fitted tightly into the various grooves.

Another embodiment of the invention is shown in FIG. 4. Here the foam sheet includes a rigid foam backing 41, a support layer 42 and sections 43 and 44 of compressible and resilient foam. As in FIG. 3, the sections of compressible and resilient foam are separated by groove 45, and narrower grooves 46 and 47 appear at the edges of foam sheet parallel to groove 45. The support layer 42 is a higher density material that provides some additional desirable attributes to the foam sheet, such as increased rigidity, moisture barrier properties, and so forth. Although support layer 42 is depicted between foam backing 41 and section 43, support layer 42 may also be positioned on the opposite side of foam backing 41. Foam backing 41 can be a rigid foam or a compressible and resilient foam, but preferably is rigid and insulating. If desired, a plurality of support layers may be used to impart desired attributes to the foam sheet.

Figure 4A:
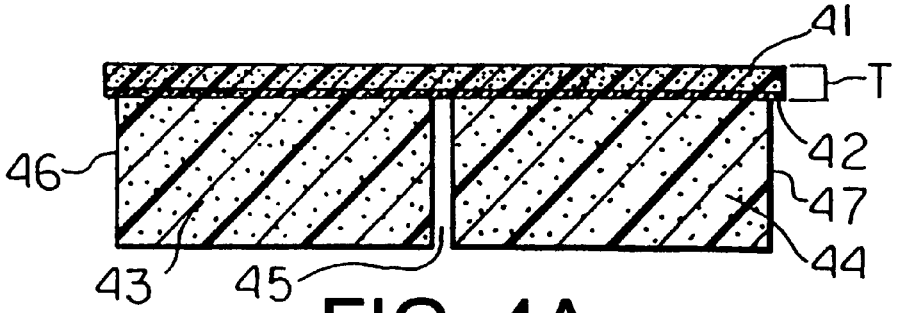
Figure 4B:
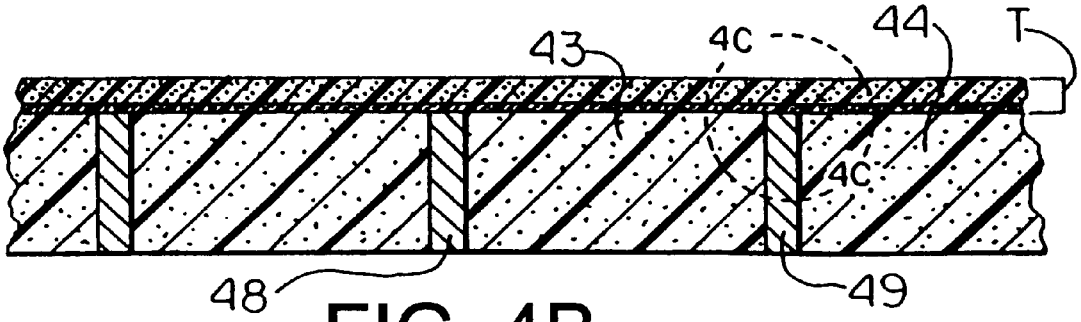

In FIG. 4B foam sheets of the type depicted in FIG. 4A but having three U-shaped grooves are shown attached to support members 48 and 49 in a wall construction.

Figure 4C:
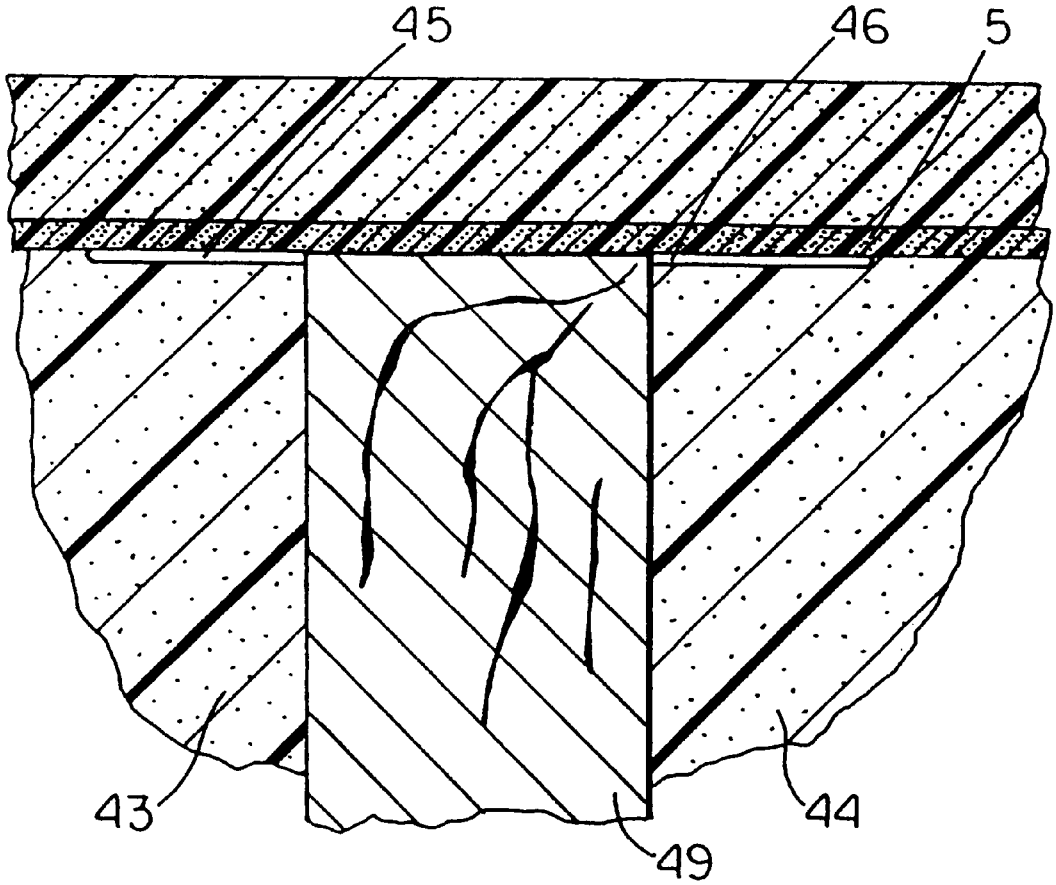

FIG. 4C illustrates a preferred feature of the invention in which sections 43 and 44 are not attached to support layer 42 proximate to the bottom of groove 45. These separations 50, 51 permit sections 43 and 44 to be compressed freely near the top of the groove (as depicted) so that support member 49 can be inserted completely into groove 43. Equivalent separations can be employed in other embodiments of the invention such as depicted in FIGS. 2, 3, 5, and 6.

Figure 5:
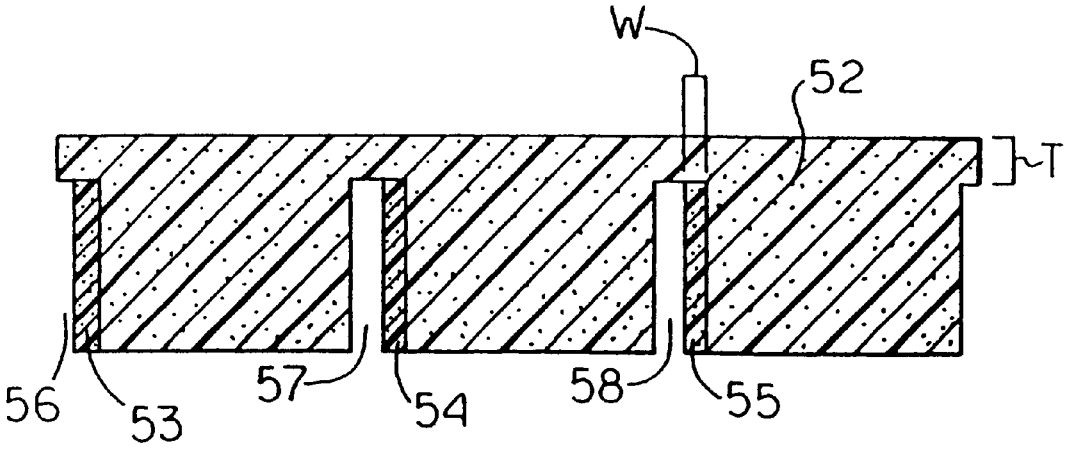

In FIG. 5, another embodiment of the invention is shown. In this embodiment, the foam sheet is mainly comprised of a rigid foam portion 52. Compressible and resilient foam portions 53, 54 and 55 having a width W line one side of grooves 56, 57, and 58. Portions 52, 53, and 54 advantageously have a height equal to the height of the groove and extend for the entire length of the foam sheet. Grooves 56, 57, and 58 have a width equal to or slightly less than the width of the support members to be inserted thereinto.

Figure 6:
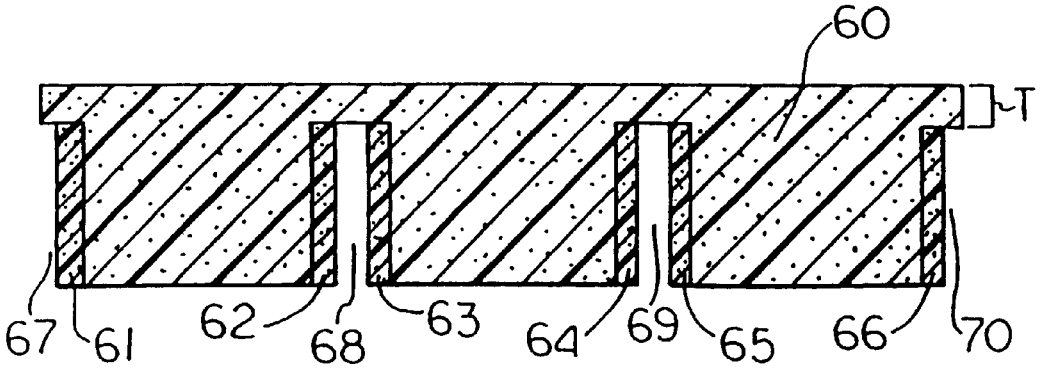

FIG. 6 illustrates another embodiment of the invention. In this embodiment, rigid foam 60 forms the major portion of the foam sheet. Compressible and resilient foam portions 61,

62, 63, 64, 65, and 66 are adjacent to grooves 67, 68, 69, and 70. Portions 61, 62, 63, 64, 65, and 66 need only be thick enough to compress sufficiently to admit a support member into the groove adjacent to the portion and then re-expand to fit tightly against the support member as described before. In this embodiment, the portions 61, 62, 63, 64, 65, and 66 are from about ⅛ inch to about 4 inches thick, preferably about ⅛ inch to about 1 inch thick.

The overall width and length of the foam sheet is preferably selected so that it is of a size and weight that it can be easily handled by construction workers. In the United States, polymer foam sheet insulation is commonly sold in 48-inch widths, which easily accommodates standard frame construction using 16-inch center spacing for the support members. Similarly, the foam sheet of this invention is preferably manufactured in a width equal to some multiple of the spacing of the support members in the wall being constructed. Widths of from about 12 inches to 96 inches are preferred, and widths of 32 to 64 inches are more preferred. Board lengths are not critical, and are selected for convenience in handling. Lengths of about 4 to about 16 feet are typically used in frame construction and are suitable for the board of this invention.

As described above, the polymer foam sheet has at least a portion that is compressible and resilient, and preferably has water-repellent and thermal insulation properties. A "compressible and resilient" foam as used herein means that an applied load of 15 psi will compress and deform a 4-inch thick section of the foam by at least 10 percent, but that such deformation is at least 80 percent reversible when the load is removed. Further, the term "rigid" foam as used herein means that a 15-psi load will compress a 4-inch thick sample of the foam by less than 10 percent, according to ASTM Test No. D-161-94.

Examples of polymers which may be used to make a compressible and resilient foam include polyethylene, polypropylene, polyurethane, ethylene vinyl acetate, polyvinyl chloride, phenol-formaldehyde resin, ethylenestyrene interpolymer, and blends of the above. Preferably, the article is a foam of polyethylene or polypropylene, and is most preferably a foam of a blend of polyethylene and polypropylene. The foam is preferably hydrophobic.

The compressible and resilient foam preferably has from 20 to 80 percent of open cells. Preferably, the foam has at least 30 percent open cells, more preferably at least 35 percent open cells, and most preferably at least 40 percent; but preferably no more than 70 percent, more preferably no more than 60 percent, according to ASTM D2856-94. The optimum number of open cells for a foam sheet will depend on the degree of compressibility needed to allow the foam to fit between the support members and to be compressed to a certain size or shape for storage and shipment prior to use (which favors the use of a large number of open cells), and on the desired insulating properties of the foam sheet (since closed cells in a foam tend to impart insulation and barrier properties). Preferably, the compressible and resilient foam has a density of at least 0.3 pounds per cubic foot (pcf), more preferably at least 0.4 pcf, most preferably at least 0.5 pcf; but preferably no greater than 1.4 pcf, more preferably no greater than 1.2 pcf, and most preferably no greater than 1.0 pcf, according to ASTM D-1622-93. Preferably, the compressible and resilient foam has an insulating R-value per inch of at least 3.0, more preferably at least 3.8, and most preferably at least 4.0, as may be measured by ASTM C-518-91.

If the portion of the compressible and resilient foam next to the groove is highly resilient and has a sufficient number of open cells, the groove may not need to be of a width any greater than a narrow slit in the foam. When the support member is placed in the groove in such an embodiment, the foam adjacent to the groove is compressed in a direction away from the groove and remains in a compressed state after the member is in place. The optimum width of the groove and the resilient portion may depend, for example, on the variations in the dimensions and placement of the studs. If the resilient foam has fewer open cells, the grooves are preferably not so small as to cause a portion of the foam between the grooves to bow outside the plane of the wall after the support members have been placed in the grooves.

The major side of the foam sheet which does not have grooves to receive the support members and forms the exterior or interior wall of the building preferably has a thickness T, as illustrated is FIGS. 2–6, of at least 0.5 inch, but is preferably no greater than 3.0 inch, and most preferably no greater than 1 inch.

The grooves in the foam sheet may be obtained by any suitable process, such as by cutting the grooves into block foam, molding a foam to the desired shape, or extruding the foam through a die which produces the desired profile. The foam sheet may be of any suitable size. Its length is preferably the same as the support member(s). The length of the sheet is preferably at least 8 feet; but is preferably no greater than 24 feet, more preferably no greater than 20 feet. The most preferred lengths are 8 feet, 12 feet, and 16 feet. Its width is preferably at least 32 inches, and the most preferred lengths are 32 inches, 64 inches, and 128 inches. Its thickness is preferably at least 2 inches, more preferably at least 4 inches; but is preferably no greater than 10 inches, more preferably no greater than 8 inches, and most preferably no greater than 6 inches.

The foam sheet of the invention may have any suitable number of grooves necessary to accommodate any number of support members. Preferably, all grooves are on one major side of the foam sheet, and the other side form the exterior portion of the wall assembly. The sheet also preferably contains at least one U-shaped groove that fits around a support member, parallel to an edge of the foam sheet, and two L-shaped grooves along the edges of the foam sheet parallel to the U-shaped groove.

In the embodiments illustrated in FIGS. 3–6, several profiles of different foams may be co-extruded, laminated together, or adhered together with a suitable adhesive, to form a multi-layer foam sheet having the desired grooves. However, in all cases at least a portion of the sheet is flexible and resilient, such portion having a length and height the same as any groove adjacent thereto and a width which will permit the groove to receive and tightly fit around a support member in a frame building construction. The foam profiles may be different in one or more respects such as composition, density, percentage of open cells, or process of making. Such an embodiment has the advantage of greater flexibility in choice of a foam for a particular function of the sheet. For example, a more rigid layer of foam may be used in the portion of the foam sheet which will form the large flat side portion of the foam sheet having a thickness T, which may be useful as a substrate and support to which other interior or exterior building components, such as exterior siding, may be attached.

In addition to the foamable polymers listed above, polystyrene may also be used to prepare this portion of the article. This layer preferably has a higher percentage of closed cells than the portion of the article that fits between the support members. Preferably, the rigid foam is an essentially closed-cell foam having at least 60 percent closed cells, more preferably at least 80 percent, and most preferably at least 90 percent. Preferably, the rigid foam has a density of at least 0.8 pcf, more preferably at least 1 pcf, most preferably at least 1.2 pcf; but is preferably no greater than 2.5 pcf, more preferably no greater than 2.2 pcf, and most preferably no greater than 2 pcf. The height of the rigid foam layer is preferably at least 0.5 inch, and is preferably no greater than 3 inches, more preferably no greater than 1 inch.

The foam sheet preferably has an integral skin on the portions of the sheet that form the interior and exterior portions of the wall assembly, to serve as a barrier to moisture entering the article. Foam skins are formed in most molding and extrusion processes, so the portions of the sheet referred to above preferably do not contain any cut foam sides. A foam skin on the portion of the article which faces the interior portion of the wall will reduce vapor transmission from the inside of the building into the wall, which may reduce or eliminate the need for a vapor barrier of a plastic film to be used on the interior of the wall. Such films are often used to prevent excessive moisture from migrating into the wall from the interior of the building, since such moisture may cause the studs and insulation materials between the studs to mildew or deteriorate. However, if the studs become wet from rain or snow during the construction process, the use of a film on the interior and exterior portions of the wall may trap moisture, which may also lead to mildew growth inside the wall. Eliminating such a plastic sheet may permit moisture inside the support members to move out of the wall, which may decrease the amount of such mildew growth.

What is claimed is:

1. An insulating polymer foam sheet having two major sides and at least one groove in at least one of said sides, wherein all grooves are located on only one major side of the sheet; wherein at least a portion of the foam sheet adjacent to the groove is compressible and resilient, said portion having a length and height the same as a groove adjacent thereto; wherein each groove and compressible portion has a width that will permit the groove to receive and tightly fit around a support member in a frame building construction; wherein the sheet is comprised of at least two different foams; and wherein the non-grooved side of the foam sheet is a rigid foam having a closed cell content of at least 60 percent, and the grooved side of the foam sheet is a compressible and resilient foam having an open cell content of at least 40 percent.

2. The foam sheet of claim 1 which additionally comprises a flat layer of material having a density higher then that of the rigid foam, which layer is parallel to the major sides of the sheet.

3. The foam sheet of claim 1 wherein the rigid foam layer defines the bottom of the groove and a portion of the resilient foam next to the groove is not attached to the foam sheet.

4. The foam sheet of claim 1 which has a length of from 8 feet to 16 feet, and a height of from 6 to 12 inches.

5. The foam sheet of claim 1 wherein the compressible and resilient portion of the foam has from 20 to 80 percent by volume of open cells therein.

6. The foam sheet of claim 1 wherein the polymeric foam is hydrophobic.

7. The foam sheet of claim 1 that has an integral skin on the major sides thereof.

8. A building wall assembly, comprising:

(a) a plurality of support members; and (b) an insulating polymer foam sheet having at least one groove in at least one of its two major sides, wherein all grooves are located on only one major side of the sheet;

wherein at least a portion of the foam sheet adjacent to the groove is compressible and resilient, said portion having a length and height the same as a groove adjacent thereto;

and wherein at least one of said support members is positioned in said groove, which fits tightly around said support member; the sheet is comprised of at least two different foams; the non-grooved side of the foam sheet is a rigid foam having a closed cell content of at least 60 percent; and the grooved side of the foam sheet is a compressible and resilient foam having an open cell content of at least 40 percent.

9. The assembly of claim 8 wherein the support members are arranged so that they have approximate equal spacing between them of 16 inches on center.

10. The assembly of claim 8 wherein the polymeric foam is hydrophobic.

11. The assembly of claim 8 wherein the groove is U-shaped and has a width of less than the width of the support member.

12. The assembly of claim 8 wherein the length of the foam sheet is the same as the length of each support member at the position it will contact the support member.

13. The assembly of claim 8 wherein the length of the groove is the same as the length of the sheet and the height of the groove is the same as the height of the support member.

14. The assembly of claim 8 wherein the foam sheet has at least three grooves on one major side of the sheet, which are parallel to each other and to an edge of the sheet.

15. The assembly of claim 8 wherein the foam sheet additionally comprises a flat layer of material having a density higher then that of the rigid foam, which layer is parallel to the major sides of the sheet.

16. The assembly of claim 15 wherein the rigid foam layer defines the bottom of the groove and a portion of the resilient foam next to the groove is not attached to the foam sheet.

17. The assembly of claim 8 which has a length of from 8 feet to 16 feet, and a height of from 6 to 12 inches.

18. The assembly of claim 8 wherein the compressible and resilient portion of the foam has from 20 to 80 percent by volume of open cells therein.

19. The assembly of claim 8 which has an integral skin on the portions of the sheet which form the interior and exterior portions of the wall.

* * * * *